US005762197A

United States Patent [19]

Farison

[11] Patent Number: 5,762,197

[45] Date of Patent: Jun. 9, 1998

[54] INFLATABLE PACKAGING CUSHION WITH INTERLOCKING ELEMENTS

[76] Inventor: Brian K. Farison, 493 River Rd., Gaylordsville, Conn. 06755

[21] Appl. No.: 735,458

[22] Filed: Oct. 23, 1996

Related U.S. Application Data

[63] Continuation-in-part of Ser. No. 565,664, Dec. 1, 1995, Pat. No. 5,588,533.

[51] Int. Cl.[6] ..... B65D 81/02

[52] U.S. Cl. ..... 206/522; 206/590

[58] Field of Search ..... 206/521, 522, 206/590–594; 383/3

[56] References Cited

U.S. PATENT DOCUMENTS

| | | |
|---|---|---|
| 3,398,501 | 8/1968 | Aninger . |
| 3,949,879 | 4/1976 | Peterson et al. . |
| 4,262,801 | 4/1981 | Avery . |
| 4,793,123 | 12/1988 | Pharo . |
| 4,918,904 | 4/1990 | Pharo . |
| 5,348,157 | 9/1994 | Pozzo . |

*Primary Examiner*—Jimmy G. Foster
*Attorney, Agent, or Firm*—The Bell Seltzer Intellectual Law Group of Alston & Bird LLP

[57] ABSTRACT

There is provided an inflatable cushion inflated through a single inflation valve. A pair of inflated panels held in place by at least one tie strap connecting the panels rest beneath each end of the bottom of an article to be protected. The cushion has a pair of inflatable end chambers interconnected to the bottom panels and a pair of inflatable side chambers interconnected to the end chambers, which when inflated protect the ends and sides of the article. This is facilitated by internal openings which allow the inflated panels to easily bend underneath the ends of the article and around the corners. There are recesses at each corner which extend from each corner of one internal opening toward a peripheral edge of the cushion to provide a wedge-like portion of the side chambers. In one of the embodiments, an additional pair of internal openings facilitates a pair of top inflatable chambers interconnected to the end chambers to rest on the top of the article. In another embodiment of the present invention, the top chambers are interconnected by inserting an inflatable hook located a the periphery of one of the top chambers through a hook receiving member located on the other top chamber to interlock the chambers together. The receiving member may be an inflatable extension of one of the top chambers and the receiving member has an opening therein for retaining the hook.

10 Claims, 3 Drawing Sheets

INFLATABLE PACKAGING CUSHION WITH INTERLOCKING ELEMENTS

CROSS-REFERENCE TO RELATED APPLICATIONS

This application is a continuation-in-part of application Ser. No. 08/565,664, filed Dec. 1, 1995 entitled: INFLATABLE PACKAGING CUSHION, and now U.S. Pat. No. 5,588,533, which is hereby incorporated herein in its entirety by reference.

BACKGROUND OF THE INVENTION

The present invention relates to inflatable packaging cushions. More particularly, the present invention relates to packaging cushions having inflatable chambers which protect all sides of an article during shipping and interlocking elements on at least two of the chambers.

When articles are packaged in a container or box for shipping there frequently are void spaces in the container. Protective packaging material for articles of different sizes and shapes is commonly used to cushion articles during shipping. There are numerous types and forms of packaging material for this purpose including waste paper, embossed paper, laminated bubble paper and plastic beads, known as peanuts. These forms of cushioning material do not always provide the cushioning needed when shipping and are generally one-use items which are thrown away after use.

In seeking better protective packaging materials various forms of air inflated cushions have been suggested. One such example is U.S. Pat. No. 4,798,123 to Pharo which discloses an inflatable bag having a pouch for retaining an article and adapted to be rolled-up to assume a spiralled configuration for cushioning the article. Such bag is inflated after the article is placed in the pouch, the air bag rolled around the package and placed in a shipping container. Another example of an inflatable packaging cushion is described in U.S. Pat. No. 5,042,663 to Heinrich, which discloses an inflatable cushion comprising a plurality of joinable flexible bladders. A further example of an inflatable packaging cushioning is set forth in U.S. Pat. No. 3,889,743 to Presnick who discloses thermoplastic bags defining an inflation chamber inside of a box. An improvement in air inflatable packaging material is shown in U.S. Pat. No. 5,348,157 to Pozzo which discloses various forms of inflatable cushions serving to protect one or more sides and/or ends of an article. These inflatable packaging cushions do not always protect all of the six sides of an article with a single cushion.

The disadvantages of the prior art packaging materials discussed above are overcome by use of the inflatable packaging cushion of the present invention as hereafter described.

SUMMARY OF THE INVENTION

Therefore, it is an object of the present invention to provide a single inflatable packaging cushion for protecting all sides of an article.

Another object of the present invention is to provide an inflatable packaging cushion which easily folds around the edges of a rectangular article.

A further object of the present invention is to provide an inflatable packaging cushion which is inflated through a single valve and protects all sides of an article.

Yet another object of this invention is to provide an inflatable cushion in which at least two of the cushion chambers are attached together by at least one tie strap.

It has been found that the foregoing objects are accomplished in accordance with this invention by providing a cushion formed from a pair of thermoplastic sheets that have been juxtaposed one upon the other, heat sealed around their peripheral edge and cut to the desired shape and size. The cushion is designed so that it may be inflated through a single inflation valve. When the cushion is at least partially inflated a pair of inflatable bottom panels rest beneath each end of the bottom of an article to be protected. These bottom panels are held in place by at least one tie strap of varying width and configuration connecting the panels. The cushion has a pair of inflatable end chambers interconnected to the bottom panels via an air passageway and a pair of inflatable side chambers interconnected to the end chambers, which, when inflated, protect the ends and sides of the article. Internal openings between each end chamber and bottom panel facilitate the inflated panels to easily bend underneath the ends of the article and around the corners. Recesses are provided which extend from each corner of an internal opening located beneath the article toward the peripheral edge of the cushion. When inflated, side chambers form wedge-like portions which come into contact with the sides of the article and tip the side chambers upwardly to wedge against the sides of the article. In one of the embodiments, a pair of internal openings facilitates a pair of top inflatable chambers one of which is interconnected to each end chamber via air passageways to rest on the top of the article. The top chambers are interconnected by inserting an inflatable hook located a the periphery of one of the top chambers through a hook receiving member located on the other top chamber to interlock the chambers together. The receiving member may be an inflatable extension of one of the top chambers and the receiving member has an opening therein for retaining the hook.

In other embodiments of the present invention, the receiving member may be a tie strap. In other embodiments the cushion may be designed to protect the end portions of an article includes a single inflatable chamber which has chamber that fold around the end of the article and the chambers interlock at one of the sides. The inflatable cushion may also be designed to have multiple interconnecting elements.

BRIEF DESCRIPTION OF THE DRAWINGS

Other objects, features and advantages of the invention will become apparent from the following detailed description of the invention when taken in conjunction with the accompanying drawings, in which.

DETAILED DESCRIPTION OF THE PREFERRED EMBODIMENTS

Figure 1:
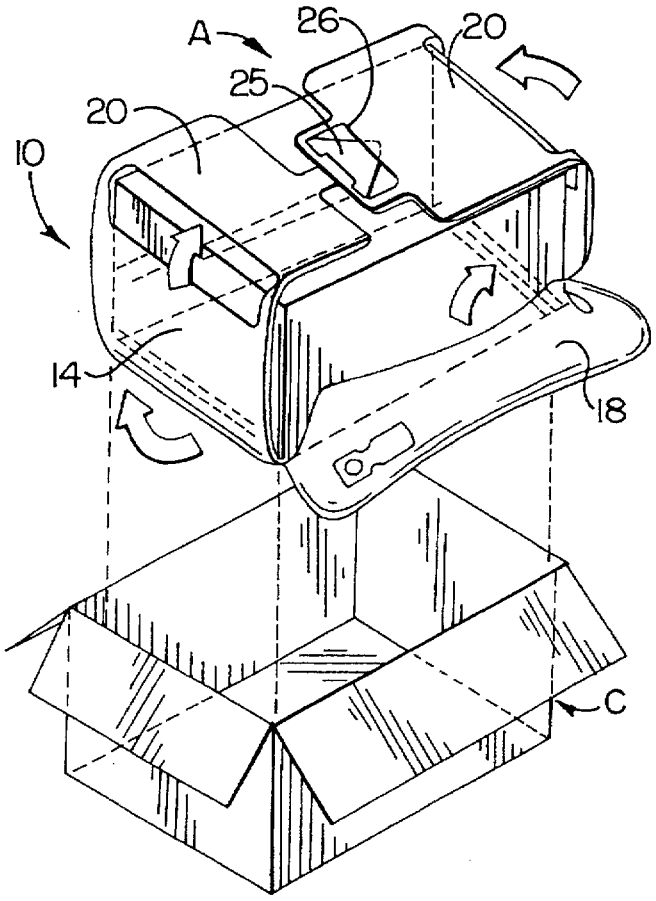
FIG. 1 is an isometric view illustrating an embodiment of the inflatable packaging cushion of the present invention in its inflated form surrounding an article to be protected as it is used in combination with a shipping container.
Figure 2:
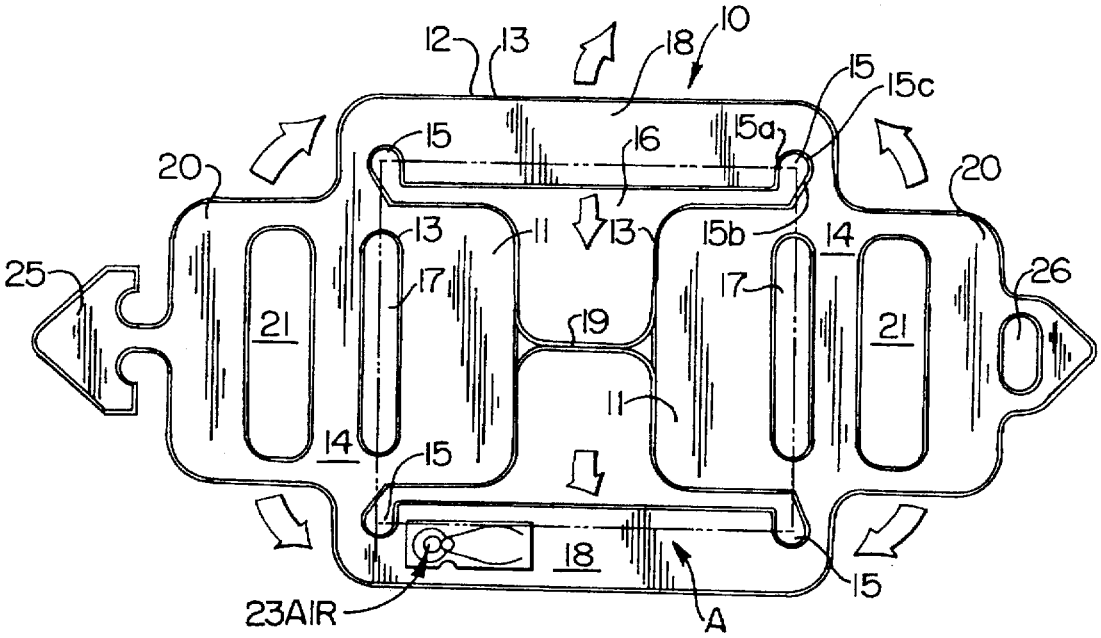
FIG. 2 is a plan view of the inflatable packaging cushion of FIG. 1 made in accordance with this invention in its deflated state.

Referring now to the drawings and in particular FIGS. 1 and 2, there is shown the inflatable packaging cushion 10 made in accordance with the present invention surrounding an article A adapted to be placed within a carton or box C.

The inflatable packaging cushion 10 includes panels or chambers interconnected through internal passageways and adapted to protect each of the sides of article A. The inflatable cushion 10 is made from two sheets of thermoplastic material which are heat sealed together around their external peripheral edge 12 and which is generally adapted to the dimensions of, for example, a box or carton C made from corrugated paperboard or the like. The inflatable cushion 10 includes an internal opening 16, capable of receiving an article A to be cushioned, defined generally by internal recesses 15 extending from each of the corners of the internal opening 16 toward the peripheral edge 12 of the cushion 10.

The inflatable cushion 10 is made of two sheets of air impervious thermoplastic material. Any number of commercially available air impervious thermoplastic materials may be used. The sheets are juxtaposed over each other and sealed together in the region of their peripheral edges—i.e., weld lines 13. The sealing may be formed by conventional techniques, for example, heat sealing. In addition, the internal edges are welded in the same manner also along weld lines 13 and the cushion cut to form the various internal openings. The thermoplastic sheets should be sufficiently flexible to adapt to the contours of the article to be packaged and, at the same time, sufficiently robust not to be pierced by possible highly projecting or pointed parts of the article A to be protected. The cushions of these materials can be deflated and reused but can also be incinerated, without release of toxic vapor, or can be recycled.

As shown in FIG. 2, the inflatable cushion 10 is designed so that when it is inflated, a pair of inflatable panels 11 lies underneath each end of the bottom of the article A. These panels 11 should be sufficiently large to provide protection to the underside of the article A when the cushion is properly inflated. An outline of article A illustrates how the article fits on the deflated cushion 10. As the cushion 10 is inflated, end chambers 14, positioned at each end of the article A and interconnected via air passageways to panels 11, rise around the corners of the article A at the recesses 15 to protect the ends of the article A. The ability of the end chambers to fit against the ends of the article is facilitated by internal openings 17 which allow the inflated end chambers 14 to easily bend around the lower edges of the article.

The pair of inflatable panels 11 are held in place by tie strap 19. The tie strap 19 may be formed as a weld seam when the peripheral edge 12 and the internal edges 13 of cushion 10 are formed and the cushion is die cut. The width and configuration of the tie strap 19 may vary. Alternately, the panels 11 may be connected by a plurality of tie straps.

The sides of the article A are protected by side inflation chambers 18, interconnected via air passageways to end chambers 14, when inflated. Side chambers 18 form wedge-like chambers which come into contact with the sides of the article and pivot upwardly, shown by the arrows in FIGS. 1 and 2, to wedge against the sides of the article.

There are internal recesses 15 at each corner extending from the corners of internal opening 16 toward a peripheral edge of the cushion. As may be seen in FIG. 2, the recesses 15 delimit wedging parts formed by side inflation chambers 18 capable of coming into contact with the article A by pivoting around zones generally defined by the area of the air passageway between the recesses 15 and the peripheral edge 12, connecting end chambers 14 and side chambers 18. The pivoting of the wedging portion of chambers 18 around the pivoting zones enables the size and/or the shape of the internal opening 16 to be varied in order to adapt it to objects of various sizes and shapes, while maintaining a holding pressure on the article by virtue of a return movement which is exerted in the region of the pivoting zones.

The shape of each recess 15 and/or of the peripheral edge 12 is such that, in this region, two pivoting zones located respectively at two locations where the space between the recesses 15 and the external peripheral edge 12 of the cushion 10 is the least. In this example, as may be seen in FIG. 2, the peripheral edge 12 is substantially straight between the end of side chambers 18 and each recess 15 is substantially droplet shaped, that is to say has a shape constituted by two lines 15*a*, 15*b* diverging from a corner of the internal opening 16 towards the peripheral edge 12 and joined together by a rounded portion 15*c* in the vicinity of the edge.

In the region of each rounded portion 15c there is a zone where the space between the said recess 15 and the external peripheral edge 12 is the least and this area defines a pivoting zone. The shapes of the recesses 15 are not unique and a person skilled in the art will be able to make modifications to them, knowing that it suffices to create, between one recess 15 and the peripheral edge 12, at least one narrowing so as to define a pivoting zone. For example, it is possible to envisage the external peripheral edge 12 having indentations in the region of each recess 15 in order to define, with the said recess, the preferential pivoting zones.

The four lateral edges of article A placed in the inflatable cushion 10 are engaged in the recesses 15; they are therefore not in contact with the cushion, which minimizes the risk of wear or of deterioration of the cushion chambers by these intersection edges. The recesses 15 moreover constitute by virtue of their deformability, preferentially impact-damping zones.

The top of article A is protected by a pair of inflatable top chambers 20 interconnected via air passageways to end chambers 14. In the embodiment shown in FIGS. 1 and 2, the top chambers 20 are sufficiently large to provide protection to the top of article A when the cushion is properly inflated. It is not necessary that the top chambers 20 overlay the entire area of the article. The size of these chambers may be easily determined by those skilled in the art. An internal opening 21 between each of the top chambers 20 and the end chambers 14 facilitate the top chambers 20 to easily bend around the upper corners of the end of the article. Of course, the internal openings 21 may be a series of smaller openings located in approximately the same location as the openings 21 shown in FIG. 2.

The inflatable chambers, such as top chambers 20 may be interconnected by inserting inflatable hook 25 located on one of the chambers through hook receiving member 26 located on another chamber, as shown in FIG. 1 to interlock the top chamber together. As shown in FIGS. 1 and 2 receiving member 26 is an inflatable extension of one of the top chambers 20 having a receiving opening therein. It should be understood that the receiving member may be a tie strap or loop such as the configuration shown in FIG. 3.

The inflatable packaging cushion 10 includes a single valve 23 for inflation. As noted in FIG. 2, the inflatable chamber is inflated through inflation valve 23 which may be located at any one of a number of regions along the sides or top of the cushion. The inflation valve 23 is any one of the well-known types of self-sealing inflating valve which typically comprises two thin sheets of plastic juxtaposed and welded together along lines so as to form a passage conduit for an inflating hose. The valve 23 is located between the two sheets forming the cushion. As a filler medium, preferably air, is passed into the inflation valve 23, the chambers and panels in the cushion 10 inflate around the article A. The internal openings 16, 17 and 21 allow the inflation panels 11, end chambers 14, side chambers 18 and top chambers 20 to easily bend underneath and around the ends and sides of the article and across the top. Furthermore, it is not necessary to completely fill the cushion with air to provide the desired protection.

Figure 5:
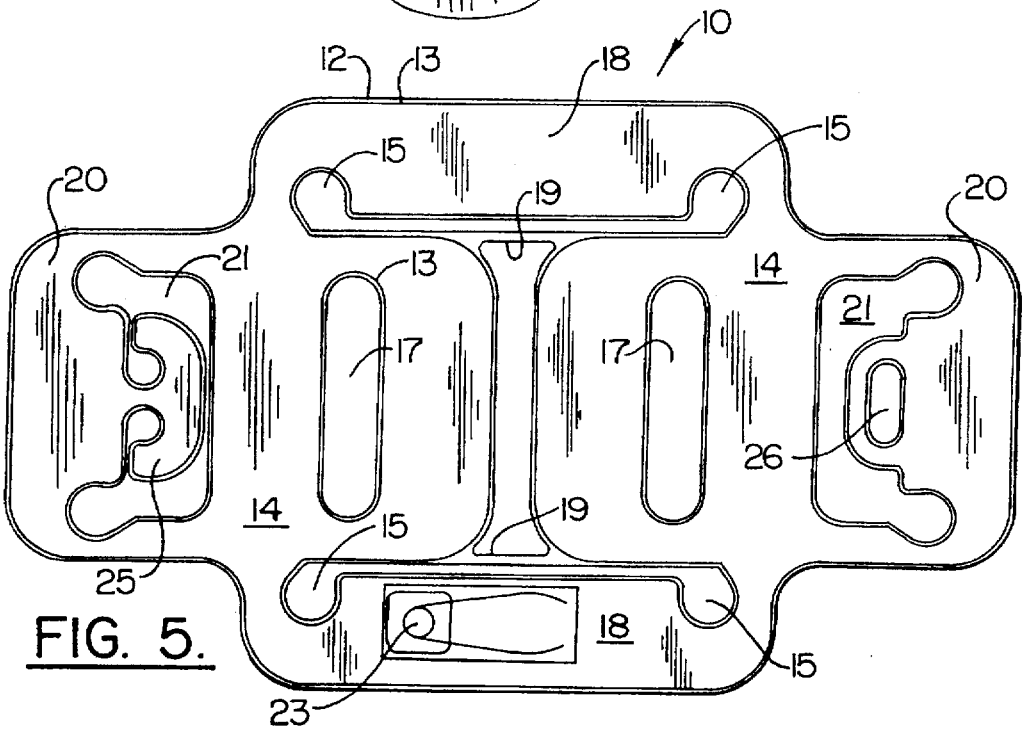
FIG. 5 is a plan view of an embodiment of the inflatable cushion of the present invention illustrating the interconnecting elements located in an internal opening.

The embodiment shown in FIG. 5 is similar to that shown in FIG. 2 in terms of the various element and mode of operation except that the interconnecting members, inflatable hook 25 and receiving member 26 are located within the internal opening 21 of chambers 20.

Figure 3:
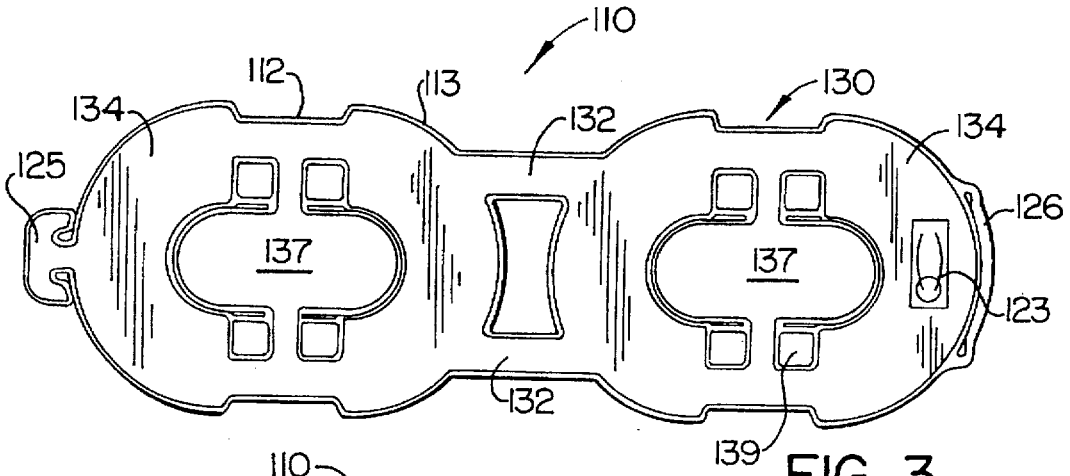
FIG. 3 is a plan view of another embodiment of the present invention illustrating the interlocking feature.
Figure 4:
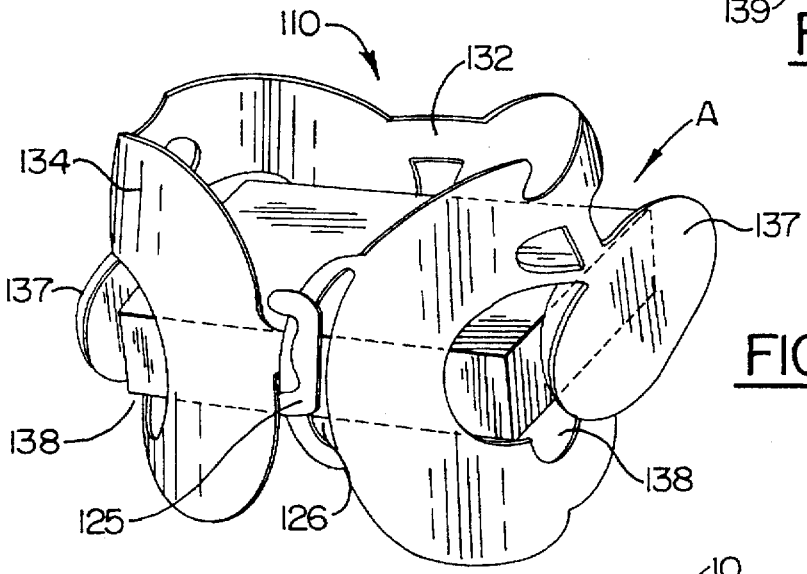
FIG. 4 is an isometric view of the embodiment of the inflatable cushion of the present invention shown in FIG. 3.

In another embodiment, that shown in FIGS. 3–4, there is provided an inflatable packaging cushion 110 made from two sheets of thermoplastic material which are heat sealed together at welds 113 around their external peripheral edge 112. The inflatable packaging cushion 110 includes a pair of similarly shaped inflatable chambers 130. Each of inflatable chambers 130 includes an outer chamber portion 134 and an end chamber portion 137. The chambers 130, as shown in FIG. 3, describe essentially an ellipsoid which is generally adapted to fit the shape and to the dimension of the end of article A. The chambers are connected via air passageways 132 so that the cushion may be filled using a single valve 123.

Each inflatable chamber 130 include internal openings 138, capable of receiving an article to be cushioned, defined generally by internal recesses 139 which extend from the ends of internal openings 138 laterally toward the peripheral edge 112. The internal openings 138, being symmetrically disposed, in conjunction with the internal recesses 139 delimit an inflatable end chamber member 137, also ellipsoid in configuration, for engaging and cushioning the distal ends of an article. Filling means 123 is located on the external surface of end member 137 whereby the filling medium enters end member 137 and proceeds to the remaining inflatable portions of chambers 130 through internal channels 132. Inflatable end chamber member 137 also retains filler medium thus providing cushioning to the end surface of the article.

The inflatable chambers 130 may be interconnected by inserting inflatable hook 125 located on one of the chambers through hook receiving member 126 located on the chamber interlock the top chamber together. The receiving member may be a tie strap or loop such as the configuration shown in FIG. 3.

Figure 6:
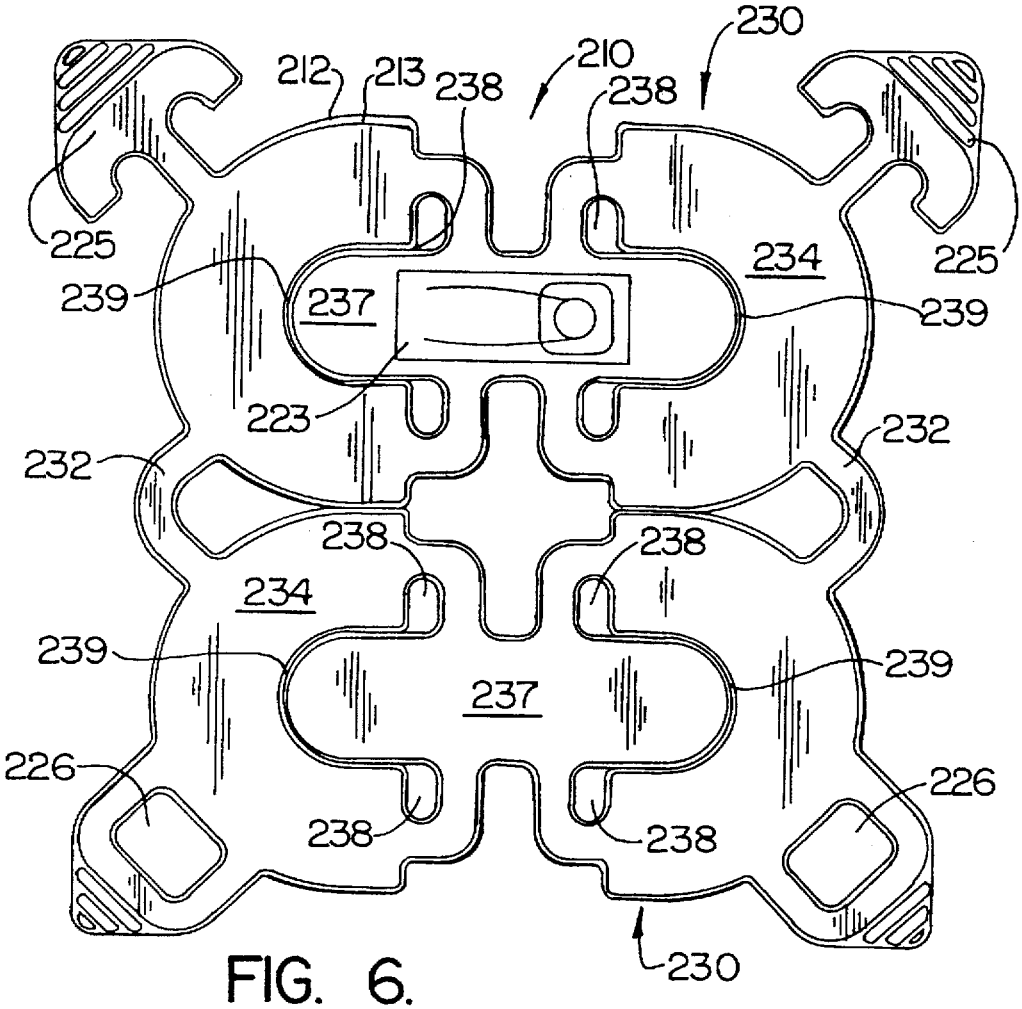
FIG. 6 is a plan view of an embodiment of the inflatable cushion of the present invention illustrating multiple interconnecting elements.

Regarding FIG. 6 there is shown another embodiment of the present invention that is similar to the embodiment of FIG. 3. There is provided an inflatable packaging cushion 210 made from two sheets of thermoplastic material which are heat sealed together at welds 213 around their external peripheral edge 212. The inflatable packaging cushion 210 includes a pair of similarly shaped inflatable chambers 230. Each of inflatable chambers 230 includes an outer chamber portion 234 and an end chamber portion 237. The chambers 230 describe essentially an ellipsoid which is generally adapted to fit the shape and to the dimension of the end of article A. The chambers are connected via air passageways 232 so that the cushion may be filled using a single valve 223.

Each inflatable chamber 230 include internal openings 238, capable of receiving an article to be cushioned, defined generally by internal recesses 239 which extend from the ends of internal openings 238 laterally toward the peripheral edge 212. The internal openings 238, being symmetrically disposed, in conjunction with the internal recesses 239 delimit an inflatable end chamber member 237, also ellipsoid in configuration, for engaging and cushioning the distal ends of an article. Filling means 223 is located on the external surface of end member 237 whereby the filling medium enters end member 237 and proceeds to the remaining inflatable portions of chambers 230 through internal channels 232. Inflatable end chamber member 237 also retains filler medium thus providing cushioning to the end surface of the article.

The inflatable chambers 230 may be interconnected by inserting multiple inflatable hooks 225 located on one of the chambers through hook receiving members 226 located on the chamber interlock the top chamber together.

In operation, the inflatable chamber is designed for an article of a specific size and is inflated and positioned around the article and then placed into a carton or box for shipping.

The invention advantageously applies to the transporting and to the handling of any fragile merchandise, and especially electronic, computer or other equipment with the ability to use a single inflatable cushion to protect all the sides of the product and to be able to reuse it several times.

The invention has been described in detail with particular reference to a preferred embodiment and the operation thereof, but it is understood that variations, modifications, and the substitution of equivalent means can be effected within the spirit and scope of the invention.

That which is claimed is:

1. An inflatable packaging cushion of flexible material adapted to be at least partially charged with filler medium and having an external peripheral edge adapted to the shape and dimensions of a packaging receptacle comprising:

said cushion having at least one internal opening capable of receiving an article to be packaged such that the sides of said article are completely encircled by a pair of inflatable end chambers interconnected with a pair of inflatable side chambers via passageways;

a pair of inflatable bottom panels interconnected to each of said end chambers and at least one tie strap located in said internal opening connecting said bottom panels so as to maintain them in position when said cushion is inflated;

a plurality of recesses extending from said internal opening toward the peripheral edges of said recesses delimiting wedging parts as portion of said side chambers, said wedging parts capable of coming into contact with the sides of said article, zones for pivoting of the wedging parts being defined between the recesses and the peripheral edge, said wedging parts being adapted so as to automatically pivot during inflation of the inflatable packaging cushion about a line extending generally between two successive recesses in order to vary the size and shape of each internal opening, said internal opening being completely encircled by said wedging parts;

at least one internal opening between each of said bottom panels and said end chambers to facilitate said cushion extending around the bottom ends of said article;

a pair of top chambers interconnected to said end chambers, one of said top chambers having an inflatable interlocking hook member and said other top chamber having a hook receiving member adapted so as to interlock said top chambers together; and filling means for at least partially charging said cushion with filler medium.

2. The inflatable packaging cushion according to claim 1 wherein said cushion comprises a pair of juxtaposed thermoplastic sheets having the outer peripheral edges thereof sealed together to form said cushion.

3. The inflatable packaging cushion according to claim 1 wherein said filling means is a single self-sealing inflation valve.

4. The inflatable packaging cushion according to claim 1 having a plurality of tie straps.

5. The inflatable packaging cushion according to claim 1 wherein said hook receiving member is inflatable.

6. The inflatable packaging cushion according to claim 1 wherein said hook receiving member is a tie strap.

7. The inflatable packaging cushion according to claim 1 wherein said filler medium is air.

8. The inflatable packaging cushion according to claim 1 wherein said hook member and said hook receiving member are located in said internal opening between said top chambers and said end chambers.

9. An inflatable packaging cushion of flexible thermoplastic material adapted to be at least partially charged with air and having an external peripheral edge adapted to the shape and dimensions of a packaging receptacle comprising:

said cushion having a pair of juxtaposed thermoplastic sheets having the outer peripheral edges thereof sealed together to form said cushion and having at least one internal opening capable of receiving an article to be packaged such that the sides of said article are completely encircled by a pair of inflatable end chambers interconnected with a pair of inflatable side chambers via passageways;

a pair of inflatable bottom panels interconnected to each of said end chambers and at least one tie strap located in said internal opening connecting said bottom panels so as to maintain them in position when said cushion is inflated;

a plurality of recesses extending from said internal opening toward the peripheral edges of said recesses delimiting wedging parts as portion of said side chambers, said wedging parts capable of coming into contact with the sides of said article, zones for pivoting of the wedging parts being defined between the recesses and the peripheral edge, said wedging parts being adapted so as to automatically pivot during inflation of the inflatable packaging cushion about a line extending generally between two successive recesses in order to vary the size and shape of each internal opening, said internal opening being completely encircled by said wedging parts;

at least one internal opening between each of said bottom panels and said end chambers to facilitate said cushion extending around the bottom ends of said article;

at least on internal opening between each of said bottom panels and said end panels;

at least one inflatable top chamber interconnected to said end chamber and having at least one internal opening between said at least one top chamber and said end chamber, and one of said top chambers having an inflatable interlocking hook member and said other top chamber having a hook receiving member adapted so as to interlock said top chambers together; and a single self-sealing inflation valve for at least partially charging said cushion with air.

10. An inflatable packaging cushion for protecting an article having corners adapted to the shape and dimensions of an enclosed container comprising:

a plurality of inflatable chambers, each of said inflatable chambers comprises a pair of juxtaposed thermoplastic sheets having the outer peripheral edges thereof sealed together to form said cushion and wherein each of said inflatable chambers substantially overlays one corner of said article such that each said corner of said article is cushioned, each of said inflatable chambers includes at least one opening located internally of said peripheral edges whereby said opening may provide flexibility to said cushion for securely engaging one said corner and said adjacent sides of said article and such that said chambers when inflated may provide cushioning to each of said corners and adjacent sides of said article, said opening being located at said corner of said article when inflated;

at least one tie strap interconnecting each of said chambers to the adjacent chamber; and a filling means for each of said chambers for at least partially inflating each chamber with a filler medium, wherein said filling means is a self-sealing inflation valve; and further comprising multiple hook members.

* * * * *